United States Patent [19]

Radke et al.

[11] Patent Number: 4,978,273

[45] Date of Patent: Dec. 18, 1990

[54] LOADER BUCKET CONTROL

[75] Inventors: Daniel D. Radke, Antwerp, Belgium; Robert M. Pabodie, Jr., Morrow, Ohio; Garry L. Ball, Lancaster, Pa.

[73] Assignee: Ford New Holland, Inc., New Holland, Pa.

[21] Appl. No.: 440,939

[22] Filed: Nov. 22, 1989

[51] Int. Cl.[5] ..... E02F 3/00; G05G 9/04

[52] U.S. Cl. ..... 414/697; 74/471 XY; 137/636.3; 414/726

[58] Field of Search ..... 74/471 XY, 504, 510, 74/501.6, 471 R; 137/636.2, 636.3; 180/333; 37/117.5, 118 R, 118 A, 103; 414/697, 722, 726, 685, 680, 705, 699

[56] References Cited

U.S. PATENT DOCUMENTS

| | | | |
|---|---|---|---|
| 3,131,574 | 5/1964 | Clingerman | 74/471 XY |
| 3,252,606 | 5/1966 | Pryor | 414/726 X |
| 3,321,990 | 5/1967 | Densmore | 74/471 XY |
| 3,773,196 | 11/1973 | Shepherd | 414/726 X |
| 3,891,042 | 6/1975 | Braun | 74/471 XY |
| 4,019,401 | 4/1977 | Drone | 74/471 XY |
| 4,027,547 | 6/1977 | Rahman et al. | 74/471 XY |
| 4,028,958 | 6/1977 | Schuermann et al. | 74/471 XY |
| 4,187,737 | 2/1980 | Mori et al. | 74/471 XY |
| 4,938,091 | 7/1990 | Waggoner et al. | 74/471 XY |

*Primary Examiner*—Robert J. Spar
*Assistant Examiner*—James T. Eller
*Attorney, Agent, or Firm*—Larry W. Miller; Frank A. Seemar; Darrell F. Marquette

[57] ABSTRACT

A control mechanism for operably controlling three functions of the loader mechanism on a tractor-loader is disclosed wherein a longitudinal, fore and aft movement of the control lever effects operation of one function, while a transverse movement of the control lever effects operation of a second function, and a rotational movement of the control lever about the axis thereof controls the third function of the loader mechanism. The control lever includes an elongated inner member affixed to a plate being supported from the frame by a universal joint permitting pivotal movement of the plate in the transverse and longitudinal directions in response to a corresponding manipulation of the control lever. The control lever also includes an elongated tubular member rotatably mounted on the inner member and connected to an additional linkage to translate rotational movement of the elongated tubular member into linear motion for controlling operation of an auxiliary device on the loader mechanism.

5 Claims, 5 Drawing Sheets

10
11
12
13
14
20
21
22
23
25
27
28
30
32
33
34
36
40
41
42
43
45
46
47
48
49
50
52
53
55
56
57
58
G
2

56
40
10
57
14
11
47
59a
49
59b
52
52
50
50
13
13
58
52
12
46
G
42
53
53
52
50
45
41
50

62
83
64
81
63
82
65
71
67
76
12
84
77
72
5

69
60
62
63
64
80
81
83
70
82
65
76
71
75
72
67
77
73
12
84
79
74
78
89
39c
39a
39b
39

60
86
83
82
81
84
76
12
77
87
65
72
63
64
71
67

60
6
83
65
76
77
84
64
81
82
62
63
69
6
71
67
12
72
7
7

LOADER BUCKET CONTROL

BACKGROUND OF THE INVENTION

The present invention relates generally to tractor-loaders having a loader apparatus mounted forwardly of the tractor, and, more particularly, to a control mechanism for incorporating three control functions of the loader apparatus into one control device.

Tractor-loaders are provided with a loader mechanism pivotally connected to the frame of the tractor and movable through manipulation of hydraulic lift cylinders and bucket tilt cylinders to effect operation of the loader mechanism forwardly of the tractor. The loader mechanism typically includes a working tool mounted at the distal end of longitudinally extending loader arms Which is pivotally connected thereto and operable through manipulation of the bucket tilt cylinders to move relative to the loader arms. Some loader mechanisms incorporate an auxiliary device such as a clam shell bucket which requires a third actuator to effect the respective movement thereof.

Typical control devices for loader mechanism provide for movement of a control lever fore and aft in a longitudinal direction to control the raising and lowering of the loader arms and a transverse, back and forth motion of the same control lever to control the roll of the bucket relative to the loader arms. Auxiliary device controls are usually operated through a separate control lever and associated linkage to actuate a third spool on the tractor hydraulic valve. Such auxiliary controls become cumbersome to operate simultaneously with the raising, lowering, and tilting of the loader mechanism through manipulation of the loader control lever. Accordingly, it would be desirable to provide a single control lever capable of effecting control of both the loader lift cylinders and the bucket tilt cylinders, as well as being capable of effecting control of an auxiliary device associated with the loader mechanism.

SUMMARY OF THE INVENTION

It is an object or this invention to overcome the aforementioned disadvantages of the prior art by providing a single control lever for controlling three operative functions of a loader mechanism with independent motion associated with the control lever.

It is another object of this invention that control of an auxiliary device can be accomplished through a rotational motion of the control lever handle associated with the control of the loader mechanism.

It is a feature of this invention that the standard longitudinal and transverse control lever motions associated with a tractor-loader control mechanism are undisturbed.

It is an advantage of this invention that the operator of a tractor-loader does not have to manipulate two separate controls to operate a loader mechanism having an operative auxiliary device.

It is another feature of this invention that the raising and tilting functions of the loader mechanism are accomplished through the pivotal movement of a plate member affixed to the control lever.

It is yet another feature of this invention that the plate member pivotally moving to effect control of the hydraulic valve directing hydraulic fluid under pressure to a loader mechanism is supported by a universal joint affixed to the frame of the tractor to permit pivotal movement of the plate while preventing rotational movement thereof.

It is another advantage of this invention that the rotational movement of the control handle does not cause a pivotal movement of the plate controlling standard operations of the loader mechanism.

It is still another object of this invention to rotatably support an elongated tubular member over an elongated inner member so that the control lever can be operable to effect control of the hydraulic spool associated with an auxiliary device through rotation of the elongated tubular member about the axis of the elongated inner member.

It is a further object of this invention to provide a loader mechanism control capable of controlling three operative functions of the loader apparatus which is durable in construction, inexpensive of manufacture, carefree of maintenance, facile in assemblage, and simple and effective in use.

These and other objects, features, and advantages are accomplished according to the instant invention by providing a control mechanism for operably controlling three functions of the loader mechanism of a tractor-loader wherein a longitudinal, fore and aft movement of the control lever effects operation of one function, while a transverse movement of the control lever effect operation of a second function, and a rotational movement of the control lever about the axis thereof controls the third function of the loader mechanism. The control lever includes an elongated inner member affixed to a plate being supported from the frame by a universal joint permitting pivotal movement of the plate in the transverse and longitudinal directions in response to a corresponding manipulation of the control lever. The control lever also includes an elongated tubular member rotatably mounted on the inner member and connected to an additional linkage to translate rotational movement of the elongated tubular member into linear motion for controlling operation of an auxiliary device on the loader mechanism.

BRIEF DESCRIPTION OF THE DRAWINGS

The advantages of this invention will become apparent upon consideration of the following detailed disclosure of the invention, especially when taken in conjunction with the accompanying drawings wherein.

DETAILED DESCRIPTION OF THE PREFERRED EMBODIMENT

Figure 1:
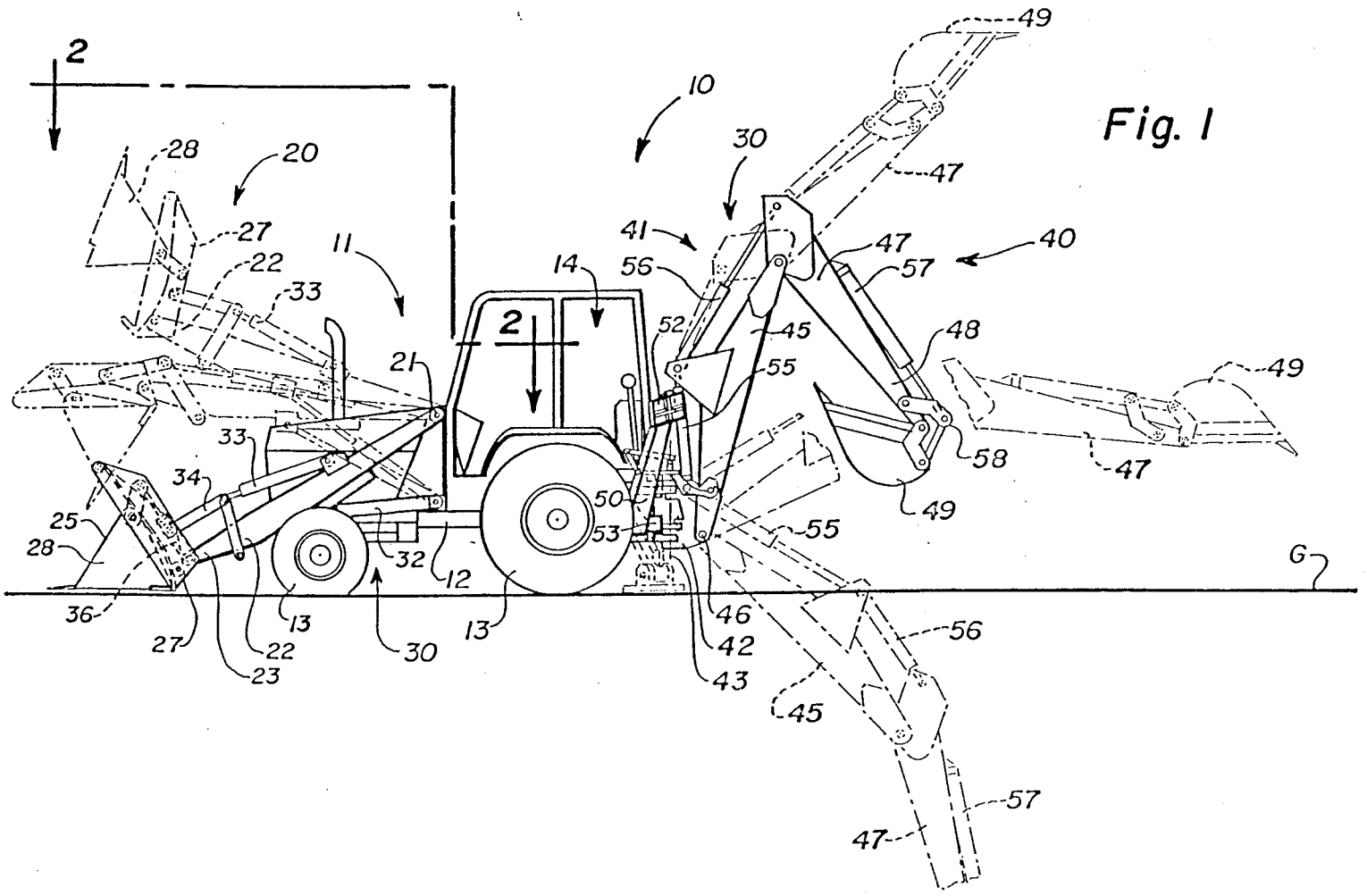
FIG. 1 is a side elevational view of a tractor-loader-backhoe incorporating the principles of the instant invention, the respective movements of the loader mechanism, articulated working tool, outrigger stabilizers, and backhoe mechanism being shown in phantom.

Referring now to the drawings and, particularly, to FIG. 1, a side elevational view of a tractor-loader-backhoe, commonly referred to as a TLB, incorporating the principles of the instant invention can be seen. Any left and right references are used as a matter of convenience and are determined by standing at the rear of the machine, facing the forward end, the direction of travel. The tractor-loader-backhoe 10 includes a prime mover 11 having a frame 12 provided with wheels 13 to permit mobile movement of the prime mover 11 over the ground G. The prime mover 11 is also provided with an operator's station 14 in which various operative controls are conveniently accessible to permit the operator to control the operable functions of the tractor-loader-backhoe 10.

Figure 2:
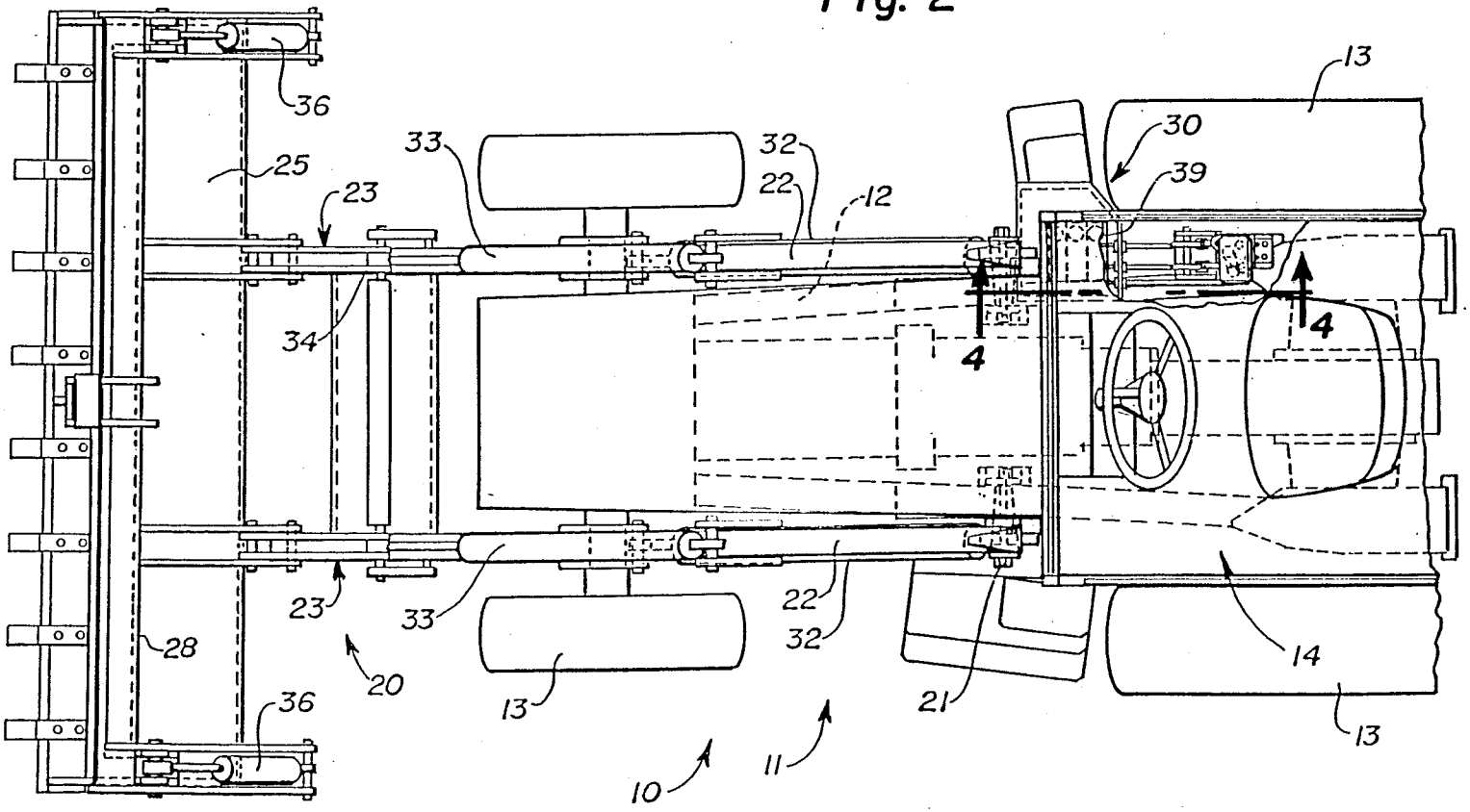
FIG. 2 is an enlarged top elevational view of the forward portion of the tractor-loader-backhoe shown in FIG. 1, corresponding to lines 2—2 of FIG. 1, to show the loader mechanism in greater detail.

As is best seen in FIGS. 1 and 2, the TLB 10 has a loader mechanism 20 mounted forwardly thereof for the handling of material. The loader mechanism 20 includes a pair of fore and aft extending loader arms 22 pivotally connected to the frame 12 for vertical movement, as shown in phantom in FIG. 1, about a generally horizontally extending axis 21, and a workinq tool 25 pivotally connected at the distal end 23 of the loader arms 22 for pivotal movement relative thereto, as is also shown in phantom in FIG. 1. The working tool 25, shown in FIGS. 1 and 2 as a bucket, can be capable of independent articulated movement, such as shown in the clam shell bucket in phantom in FIG. 1. Such buckets would include at least a base member 27 affixed to the loader arms 22 and a movable member 28 pivotally supported from the base member 27 to be movable relative thereto.

The prime mover II is provided with a conventional power source (not shown) including a hydraulic system 30 providing a source of hydraulic fluid under pressure to various hydraulic components carried by tractor-loader-backhoe 10. The hydraulic system 30 includes a pair of hydraulic cylinders 32 interconnecting the frame 12 of the prime mover 11 and the loader arms 22 to power the pivotal movement thereof about the horizontal axis 21. Similarly, a pair of co-acting hydraulic cylinders 33 interconnecting the loader arms 22 and a linkage 34 operably connected to the working tool 25 effects pivotal movement of the working tool 25 relative to the loader arms 22. For those machines 10 incorporating an articulated working tool 25, the hydraulic system 30 would also include a pair of transversely disposed co-acting hydraulic cylinders 36 interconnecting the base member 27 and the movable member 28 to effect articulation of the movable member 28 relative to the base member 27. Each hydraulic cylinder 32, 33, 36 would be provided with conventional plumbing connections (not shown) to provide hydraulic fluid under pressure thereto through a control valve 39 supported on the frame 12 adjacent the operator's compartment 14 to control the direction of flow of hydraulic fluid through the hydraulic system 30 in a conventional manner.

Figure 3:
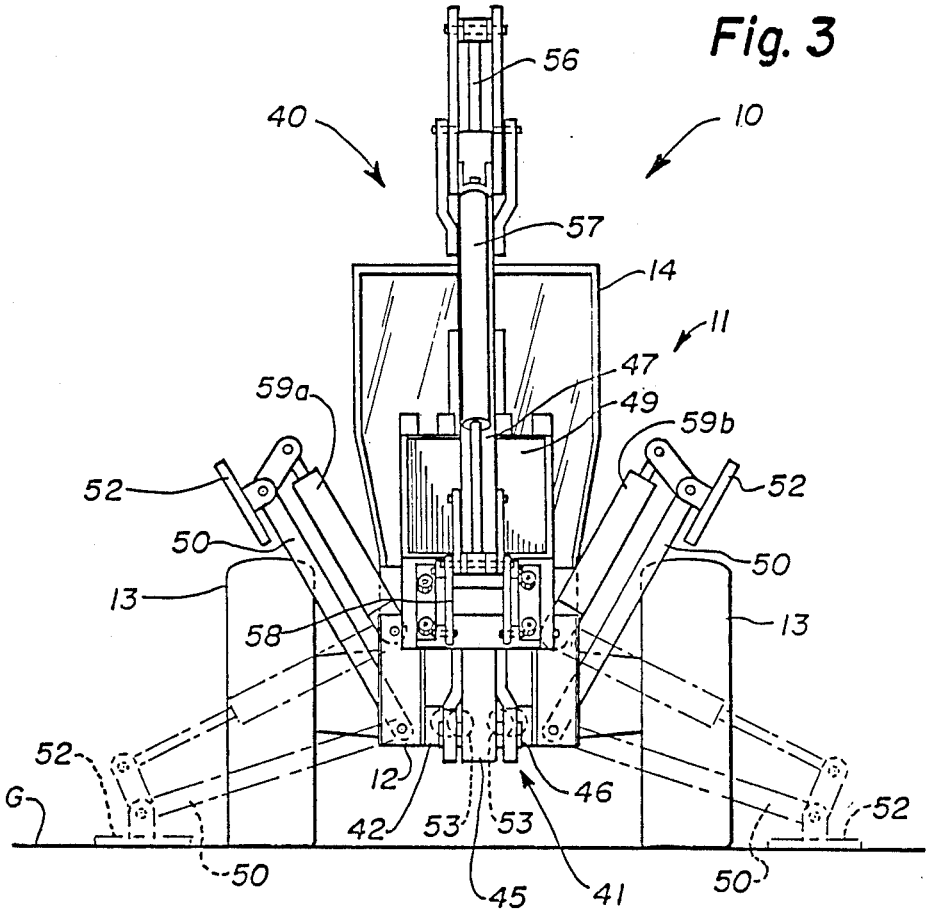
FIG. 3 is a rear elevational view of the tractor-loader-backhoe seen in FIG. 1, depicting the backhoe mechanism mounted thereon in a transport position, the pivotal movement of the outrigger stabilizers being shown in phantom.
Figures 4, 7:
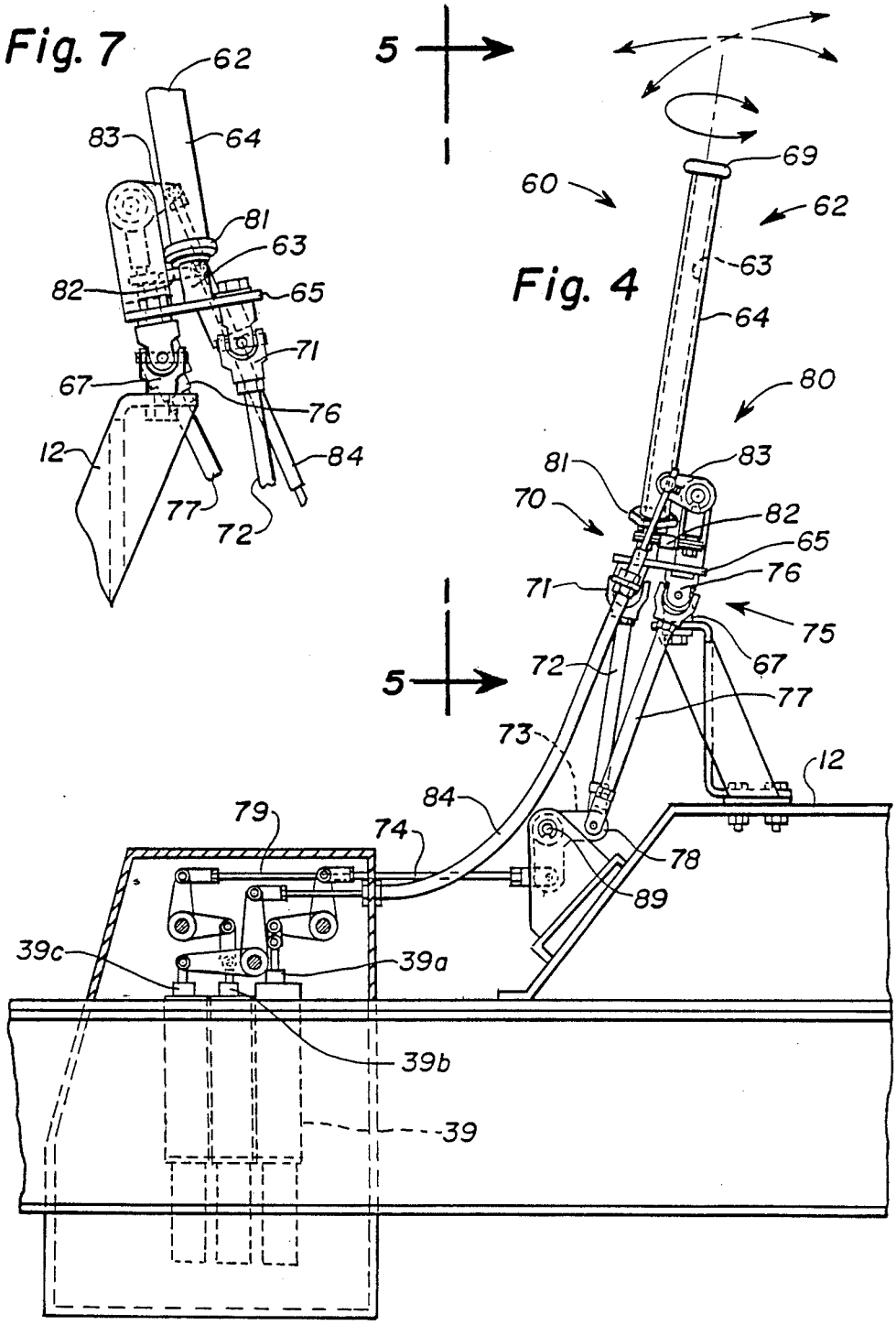
FIG. 4 is an enlarged side elevational view of the control mechanism corresponding to the cross-section taken along lines 4—4 of FIG. 2.
FIG. 7 is a side elevational view of the control mechanism opposite to that of FIG. 4, taken along lines 7—7 of FIG. 5.

Referring now to FIGS. 1 and 3, it can be seen that the tractor-loader-backhoe 10 is also provided with a backhoe mechanism 40 mounted at the rearward end of the prime mover 11 for pivotable operation in a known manner. The backhoe mechanism 40 includes a boom assembly 41 including a mounting member 42 pivotally connected to the frame 12 to permit pivotal movement of the boom assembly 41 about a generally vertically extending axis 43. The boom assembly 41 also includes a boom member 45 pivotally connected to the mounting member 42 for generally vertical movement about a horizontally extending axis 46 and a dipper member 47 pivotally connected to the boom member 45 for articulated movement relative thereto a common vertical plane therewith. The boom assembly 41 also includes a digging bucket 49 pivotally connected to the distal end 48 of the dipper member 47 for articulated movement relative thereto in a conventional manner.

When the backhoe mechanism 40 is being operated, a means for stabilizing the motion of the prime mover II, i.e., to restrain rolling motion of the wheels 13, is customarily provided. The machine 10 is provided with a pair of laterally extending outrigger stabilizers 50 pivotally connected to the frame 12 of the prime mover 11 for movement between an elevated transport position, shown in solid lines in FIG. 3, and a ground engaging position, shown in phantom in FIG. 3. Each outrigger stabilizer 50 is provided with a ground engaging shoe 52 which can be constructed in a number of configurations to complement the surface of the ground G to be engaged. By sufficient downward pressure of the loader mechanism 20 and the outrigger stabilizers 50, the prime mover 11 can be elevated to the extent that the wheels 13 are not engaged with the ground G during operation of the backhoe mechanism 40.

To power the operation of the backhoe mechanism 40 and the outrigger stabilizers 50, the hydraulic system 30 is also provided with swing cylinders 53 interconnecting the frame 12 of the prime mover 11 and the mounting member 42 to effect pivotal movement thereof in a generally horizontal plane about the vertical axis 43. The hydraulic system 30 also includes a boom cylinder 55 interconnecting the mounting member 42 and the boom member 45 to power the vertical movement of the boom member 45, dipper member 47, and bucket 49 about the horizontal axis 46. The hydraulic system 30 also includes a dipper cylinder 56 interconnecting the boom member 45 and the dipper member 47, as well as a bucket cylinder 57 interconnecting the dipper member 47 and the bucket 49 through a conventional connecting linkage 58. Each outrigger stabilizer 50 is provided with an individually operable cylinder **59*a*, 59*b* to permit level stabilization of the prime mover 11 on sloping ground, as is conventionally known. Each hydraulic cylinder 53, 55, 56, 57, 59*a*, and 59*b* is independently operable through a conventional control mechanism (not shown) located in the operator's compartment 14**.

Customarily, the backhoe mechanism 40 is operable, through appropriate manipulation of the hydraulic system 30, to dig at an elevation lower than the surface of the ground G in which the prime mover 11 is positioned, as shown in phantom in FIG. 1. The backhoe mechanism 40 can be articulated into a compact transport position shown in FIGS. 1 and 3, centrally located relative to the line of travel of the prime mover 11, for transport thereof over the ground G. When the backhoe mechanism 40 is placed into this transport position, the boom cylinder 55 is completely collapsed to a fully retracted position, while the dipper cylinder 56 and the bucket cylinder 57 are extended. In addition, the transportation of the machine 10 over the ground G requires a raising of the outrigger stabilizers 50 to the transport position which results in a complete retraction of the associated hydraulic cylinders 59*a*, 59*b*.

Referring now to FIGS. 4–7, the control mechanism 60 for operating the loader apparatus 20 can best be seen. The control mechanism 60 includes a control lever 62 positioned within the operator's compartment 14 for convenient access by the operator. The control lever 62 is consists of an elongated inner member 63 and an elongated outer tubular member 64 rotatably mounted on the elongated end member 63 for rotation relative thereto. The elongated inner member 63 is affixed to a plate 65 supported from the frame 12 by a universal joint 67 which is oriented to facilitate pivotal movement of the plate 65 in a longitudinal direction and in a transverse direction, as will be described in greater detail below. A handle 69 is affixed to the elongated tubular member 64 to be rotatable therewith. Any longitudinal or transverse movements of the control lever 62 are induced through a corresponding motion of the handle 69, which is transferred to the elongated inner member 63 due to the tubular member 64 being concentrically mounted thereon.

Figure 6:
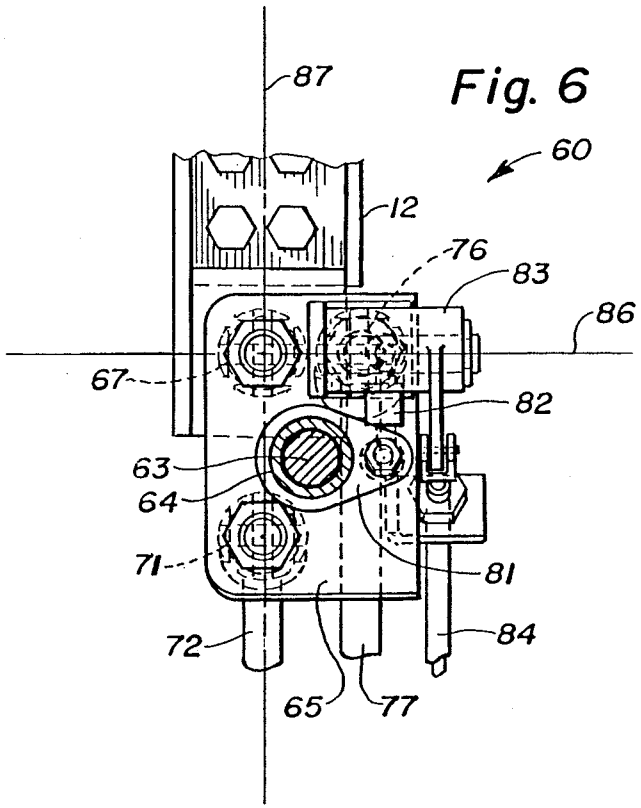
FIG. 6 is a cross-sectional view of the control mechanism taken along lines 6—6 of FIG. 5 to shown the details of the connecting linkage transferring motion of the control lever to operative movements of the hydraulic valve.
Figure 5:
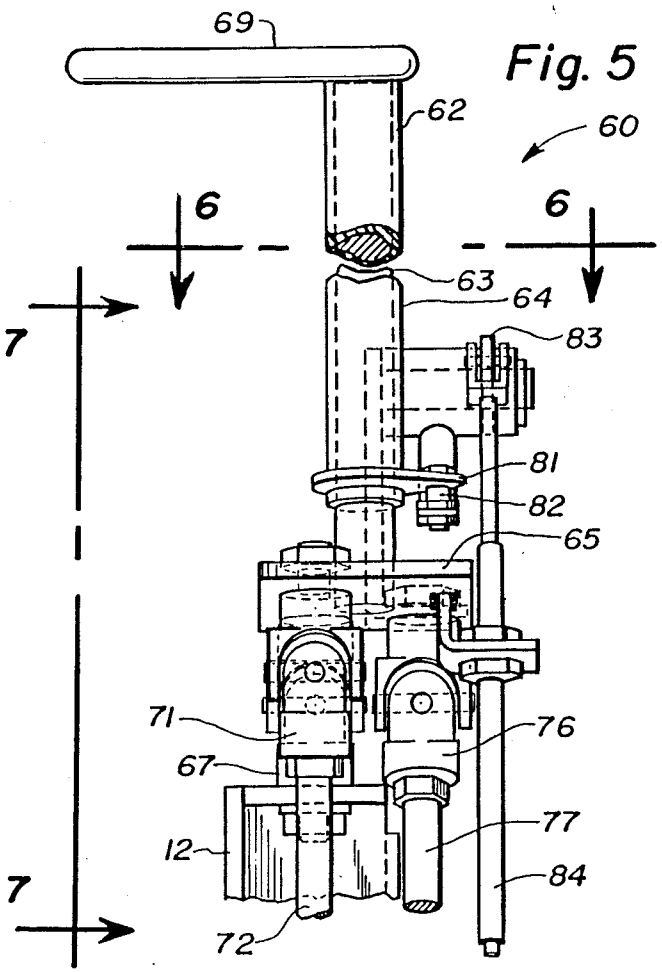
FIG. 5 is a front elevational view of the control mechanism seen in FIG. 4 corresponding to the cross-sectional view taken along lines 5—5 of FIG. 4.

The plate 65 is also connected to first and second linkages 70, 75 which are operably connected to respective spools 39*a*, 39*b* of the hydraulic valve 39 to control the direction of flow of hydraulic fluid to the loader lift cylinders 32 and to the bucket tilt cylinders 33, respectively. The first linkage 70 includes a first universal joint 71 connected to a first link member 72 attached to a bell crank 73, which is also fastened to a second link 74 pinned to the first spool 39*a* of the hydraulic valve 39. The second linkage 75 includes a second universal joint 76 affixed to the plate 65, a top link member 77 interconnecting the second universal joint 76 and a second bell crank 78, which in turn is connected to a bottom link member 79 pinned to the second spool 39*b* of the hydraulic valve 39. The first and second bell cranks 73, 78 are transversely spaced and mounted on a common pivot 89 for individual operation with the associated linkage 70, 75, respectively. As is best seen in FIG. 6, the first universal joint 71 is positioned longitudinally with respect to the frame universal joint 67, while the second universal joint 76 is positioned transversely of the frame universal joint 67.

The elongated tubular member 64 is connected to a third linkage 80 which includes a bell crank 83 interconnected with a flange 81 on the elongated tubular member 64 by a third link member 82 and being connected to a push-pull cable 84 controlling the movements of a third spool 39*c* on the hydraulic valve 39. As will be described in greater detail below, the third linkage 80 converts rotary motion of the elongated tubular member 64 relative to the elongated inner member 63 on which the tubular member 64 is mounted into a linear motion operably controlling the third spool 39*c* of the hydraulic valve 39.

In operation, the operator manipulates the handle 69 affixed to the top of the control lever 62 to move the control lever 62 in a longitudinal direction to effect operation of the loader lift cylinders 32 for raising and lowering the loader mechanism 20. A longitudinal movement of the control lever 62 causes a pivotal motion of the plate 65 about a transversely extending line 86 defined by the frame universal joint 67 and the second universal joint 76. Such pivotal movement of the plate 65 displaces the first linkage 70 in a generally vertical direction, effecting pivotal movement of the first bell crank 73 and a corresponding linear movement of the first spool 39*a* of the hydraulic valve 39. The movement of the first spool 39*a* of the hydraulic valve 39 controls the direction of flow of hydraulic fluid under pressure to the loader lift cylinders 32 to effect a corresponding raising or lowering of the loader arms 22.

Similarly, a transverse movement of the control lever 62 induced through manipulation of the handle 69 effects a pivotal movement of the plate 65 about a longitudinal line 87 defined through the frame universal 67 and the first universal joint 71, thereby effecting a generally vertical displacement of the second linkage 75. As noted above with respect to the first linkage 70, such vertical movement of the second linkage 75 effects a pivotal movement of the second bell crank 78 which is translated into a corresponding linear movement of the second spool 39*b* of the hydraulic valve 39 to control the direction of flow of hydraulic fluid under pressure to the bucket tilt cylinders 33 to manipulate the pivotal movement of the bucket 25 relative to the loader arms 22.

For those working tools 25 incorporating an articulation joint defining pivotable movement between a base member 27 and a movable member 28, effected by extension of a linear actuator such as the articulation cylinders 36, the rotation of the elongated tubular member 64 effected by an appropriate turning of the handle 69 affixed to the elongated tubular member 64 will control the articulation cylinders 36. The rotative movement of the elongated tubular members 64 is transmitted directly to the third bell crank 83 by the third link member 82 to effect a pivoting thereof, which in turn effects a linear movement of the third spool 39*c* of the hydraulic valve 39 through the manipulation of the push-pull cable 84.

It will be understood by one skilled in the art that the frame universal joint 67 interconnecting the plate 65 and the frame 12 prevents the plate 65 from rotating with the rotative manipulation of the elongated tubular member 64, as the frame universal joint 67 will permit pivotal movement of the plate in the longitudinal and transverse directions but not a rotative movement thereof. Accordingly, all three loader apparatus 20 functions, i.e., lift, tilt, and grab, can be accomplished through appropriate manipulation of a single control lever conveniently accessible to the operator. Furthermore, the control lever 62 can be manipulated to effect simultaneous operation of all three functions, or any combination thereof.

It will be understood that changes in the details, materials, steps, and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description may be employed in other embodiments without departing from the scope of the invention. Accordingly, the following claims are intended to protect the invention broadly as well as in the specific form shown.

Having thus described the invention, what is claimed is:

1. In a loader having a prime mover including a wheeled frame; a loader mechanism pivotally supported from said frame for generally vertical movement relative thereof, said loader mechanism including a pair of transversely spaced loader arms pivotally attached to said frame at one end thereof for movement thereof about a generally horizontal axis and a loader bucket pivotally attached to the distal end of said loader arms, said loader bucket being articulated for movement bout a transversely extending axis between an open position and a closed position; a power means operably associated with said loader mechanism to effect movement thereof, said power means including a first linear actuator interconnecting said loader arms and said frame to effect said generally vertical movement of said loader arms, a second linear actuator interconnecting said loader arms and said loader bucket to control the pivotal movement of said loader bucket relative to said loader arms, and a third linear actuator mounted on said loader bucket to control the articulated movement thereof; and control mechanism operably associated with said power means to control the operation of said linear actuators, an improved control mechanism comprising:

a control lever operably connected to said power means and being movable in a longitudinal direction to control one of said linear actuators, in a transverse direction to control a second of said linear actuators, and in a rotational direction to control the third of said linear actuators, and wherein said rotational direction relates to the axis of said control lever perpendicular to both said longitudinal and transverse directions, and wherein said control lever includes a first elongated member operably connected to a first linkage means operable to translate movement thereof in both said longitudinal and transverse directions for operable control of said first and second linear actuators, said control lever further including an elongated tubular member rotatably mounted on said first elongated member for rotation about the elongated axis of said first elongated member, said elongated tubular member being connected to a second linkage means to translate said rotational movement for operable control of said third linear actuator, and wherein said first linkage means includes a plate affixed to said first elongated member, said plate being supported from said frame by a universal joint permitting pivotal movement of said plate in a longitudinal direction and in a transverse direction in response to the movement of said control lever in said longitudinal and transverse directions without permitting rotation of said plate.

2. The loader of claim 1 wherein said linear actuators are hydraulic cylinders operably powered by a hydraulic system including a control valve to direct the flow of hydraulic fluid to said hydraulic cylinders, said control valve including first, second and third spools corresponding, respectively, to said first, second and third hydraulic cylinders, said first linkage means being connected to said first and second spools and said second linkage means being connected to said third spool.

3. The loader of claim 2 wherein said first linkage means also includes first linkage members interconnecting said plate and said first spool to effect movement of said first spool in response to movement of said control lever in said longitudinal direction, and second linkage members interconnecting said plate and said second spool to effect movement of said second spool in response to movement of said control lever in said transverse direction.

4. The loader of claim 3 wherein said second linkage means includes a bell crank, a link interconnecting said bell crank and said elongated tubular member, and a cable interconnecting said bell crank and said third spool such that rotational movement of said elongated tubular member causes a pivotal movement of said bell crank and a resulting movement of said cable and said third spool.

5. The loader of claim 4 wherein said elongated tubular member is affixed to a handle accessible to the operator of said loader, said handle being contoured to fit the palm of the operator's hand to facilitate the movements of said control lever in said longitudinal, transverse, and rotational directions.

* * * * *